United States Patent [19]

Maeda

[11] Patent Number: 4,697,481

[45] Date of Patent: Oct. 6, 1987

[54] INTEGRALLY MOLDED HAMMER WITH SEPARATED HEAD AND HANDLE CORES

[75] Inventor: Sadao Maeda, Okazaki, Japan

[73] Assignee: Maeda Shell Service Co., Ltd., Aichi, Japan

[21] Appl. No.: 829,111

[22] Filed: Feb. 14, 1986

[30] Foreign Application Priority Data

| | | | |
|---|---|---|---|
| Feb. 21, 1985 | [JP] | Japan | 60-33417 |
| May 17, 1985 | [JP] | Japan | 60-74032[U] |
| May 17, 1985 | [JP] | Japan | 60-74033[U] |

[51] Int. Cl.[4] ..... B25D 1/02

[52] U.S. Cl. ..... 81/22; 81/177.6

[58] Field of Search ..... 81/22, 19, 20, 177.6

[56] References Cited

U.S. PATENT DOCUMENTS

| | | | |
|---|---|---|---|
| 52,696 | 2/1866 | Eddy | 81/19 |
| 2,295,316 | 9/1942 | Yates | 81/177.6 |
| 2,332,384 | 10/1943 | Koster | 81/19 |
| 2,604,914 | 7/1952 | Kahlen | 81/22 |
| 3,779,296 | 12/1973 | Echeverria | 81/22 |
| 4,039,012 | 8/1977 | Cook | 81/22 |
| 4,188,703 | 2/1980 | Fish | 81/22 |
| 4,287,640 | 9/1981 | Keathley | 81/22 |

FOREIGN PATENT DOCUMENTS

| | | | |
|---|---|---|---|
| 625795 | 8/1961 | Canada | 81/22 |
| 58041 | 12/1911 | Fed. Rep. of Germany | 81/177.6 |
| 116250 | 4/1946 | Sweden | 81/22 |
| 846702 | 8/1960 | United Kingdom | 81/22 |

*Primary Examiner*—Frederick R. Schmidt
*Assistant Examiner*—Bradley I. Vaught
*Attorney, Agent, or Firm*—Parkhurst & Oliff

[57] ABSTRACT

A hammer including a head core and a handle core which are made of a metallic material and are respectively imbedded in head and handle portions made of a resin material so as to form a generally T-shaped integral body. The head core and the handle core are separated from each other by a suitable distance by a portion of the resin material at which the head and handle portions are connected to each other.

9 Claims, 19 Drawing Figures

INTEGRALLY MOLDED HAMMER WITH SEPARATED HEAD AND HANDLE CORES

BACKGROUND OF THE INVENTION

1. Field of the Art

The present invention relates generally to a hammer having a head portion and a handle portion both made of a resin material and cooperating to form a generally T-shaped integral body, comprising head and handle cores imbedded in the respective head and handle portions, and more particularly to such a hammer wherein the propagation of an impact shock from the head portion to the handle portion is effectively minimized.

2. Related Art Statement

A hammer including a head portion and a handle portion both made of a suitable resin material and cooperating to form a generally T-shaped integral body is available for use in various fields such as construction and assembly sites or shops.

In such an integrally molded hammer, the head and handle cores cooperating to generally form a T-shape are generally imbedded in the head and handle portions, respectively, so as to gain a sufficient strength for withstanding an impact given when the hammer is struck. The conventional hammer, therefore, has a problem that the impact at the striking moment is transmitted to the user's hand directly through the hard cores, which will increase efforts and labor of the user, thus reducing the operating efficiency.

In order to alleviate this problem, there has been proposed a so-called shock-proof or non-rebound hammer (disclosed, for example, in U.S. Pat. No. 4,039,012) having a hollow core imbedded in the head portion and filled with lead pellets of a suitable size. In such a shock-proof hammer, the impact given to the user is remarkably reduced because the impact at the striking moment is absorbed by friction of the lead pellets.

PROBLEMS SOLVED BY THE INVENTION

In the conventional shock-proof hammer as stated above, however, the impact force and the resulting rebound of the hammer are reduced because the impact force itself is absorbed by the lead pellets. Consequently, there are inconveniences in that the working efficiency is reduced due to the reduced rebound and the increased striking efforts of the user in swinging back the hammer for repeated hammering actions.

Moreover, the lead pellets accommodated in the hollow head core tend to be pulverized due to the impact stresses. The lead particles may also cohere into larger blocks due to the friction, heat, etc., whereby the shock-absorbing capability of the lead pellets may be lowered. Further, numerous lead pellets are required for such a hammer, which results in an increase in the cost of the hammer.

SUMMARY OF THE INVENTION

It is an object of the present invention to provide an improved hammer which is easy to use.

According to the present invention, there is provided a hammer including a head portion and a handle portion made of a predetermined resin material and cooperating to form a generally T-shaped integral body, comprising a head core which is at least partially imbedded in the head portion in a longitudinal direction of the head portion, and a handle core which is imbedded in the handle portion in a longitudinal direction of the handle poriton. The head and handle cores are separated from each other by a predetermined distance by a portion of the resin material by which the head and handle portions are connected.

In the integrally molded hammer of the present invention, the impact given to the head portion when the hammer is struck against the object is absorbed by a mass of the resin material which fills the space between the head and handle cores, whereby the impact propagation from the head core to the handle core is greatly reduced. This permits a remarkable reduction in the shock given to the worker's hand holding the handle portion. The thus constructed hammer maintains high shock-absorbing effects for a comparatively longer period, unlike the shock-proof hammer containing recoil-inhibiting lead pellets which tend to gather into blocks during use.

As the striking or driving force to be given by the head portion to an object is not reduced at all, the impact rebound of the hammer is likewise not reduced. Hence, the user can perform effortless hammering operations with easy back-swing actions. Thus, the present hammer is not only capable of minimizing an impact shock to be given to the user, but is also capable of reducing the striking efforts of the user.

The present hammer is produced in a simple molding process in which the head and handle cores are first disposed in a mold with a predetermined distance kept therebetween, and the resin material is introduced to encase the cores integrally. Therefore, the present hammer provides a considerable savings in manufacturing and material costs, as compared with the conventional shock-proof hammer filled with lead pellets.

Since the strength of the hammer is more or less reduced at the connection between the handle portion and the head portion, the distance between the head and handle cores should be as small as possible within a predetermined range to maintain the intended shock-absorbing effects. For example, the distance about 3–30 mm is desirable, though the optimum distance varies according to the kind of the resin material which connects the head and handle cores. Depending upon the distance, any resin material can be employed provided it has enough mechanical strength to bear the impact stresses and enough resilience to absorb a part of the impact shock to be impacted to the handle core. For example, a polyurethane resin material having Shore hardness 40–70 (Hs-D scale) can be preferably employed.

The head and handle cores may be connected by a resilient member in the form of a coil spring so as to allow a relative displacement between the cores. This arrangement eliminates a possibility that the head portion may go off from the handle portion in the event of a fracture of the resin material at the connection between the head and handle cores due to impact stresses applied to the hammer. Thus, the hammer provides sufficient operating safety while maintaining the shock-absorbing function.

The head core may be exposed at one of its opposite ends, so as to provide an impact surface at a corresponding end of the head portion. In this case, the other end of the head core cooperates with the resin material to provide a resin-covered impact surface. Namely, when the head core is made of a metal, its one end portion provides a metallic peen, while the other end portion provides a resin-covered impact peen. In this case, the above-indicated other end portion of the head core may have a transverse dimension which decreases toward the end face, over a predetermined length in the longitudinal direction of the head portion. As compared with the resin-covered impact peen having a constant transverse dimension, the resin-covered impact peen having a gradually decreasing transverse dimension is less likely to suffer cracking of its resin covering. This reduced possibility of cracking of the resin material at the resin-covered peen is attributed to improved distribution of impact stresses at the resin-covered peen. Therefore, the above-indicated dimensioning of the head core at the resin-covered peen permits increased durability of the hammer.

In one form of the above advantageous arrangement, the head core comprises a large-diameter part at the above-indicated one end, a small-diameter part which has the resin-covered peen and is imbedded in the resin material of the head portion, and a neck part connecting the large-diameter part and the small-diameter part. The neck part defines a circumferential groove, which accommodates the resin material to firmly hold the head core in the mass of the resin material.

In the case where the head portion is exposed at its one end to provide a hard impact peen, the head core may have a balance weight incorporated in the other end thereof. This balance weight is made of a material having a specific gravity larger than that of a material of the head core. In this preferred form of the invention, the hammer is properly balanced in the longitudinal direction, even if the resin-covered peen (small-diameter part indicated above) is adapted with a decreasing transverse dimension, for the reason indicated above. The balance weight makes it possible to use the hammer with the same hammering feel, irrespective of whether the hard peen or the resin-covered peen is struck against an object.

In the above case, the head core may be made of a ferrous material, and the balance weight may be made of lead or a lead alloy. The balance weight is preferably positioned so that it extends from the end face of the above-indicated other end of the head core toward the above-indicated one end. Preferably, the head core comprises a large-diameter part having the exposed impact surface, a small-diameter part which incorporates the balance weight and is imbedded in the resin material of the head portion, and a neck part connecting the large-diamter part and the small-diamter part. The neck part defines a circumferential groove as previously indicated.

BRIEF DESCRIPTION OF THE DRAWINGS

The above and other objects, features and advantages of the present invention will be better understood from reading the following detailed description of preferred embodiments of the invention, when considered in connection with the accompanying drawings, in which.

DETAILED DESCRIPTION OF THE PREFERRED EMBODIMENTS

In order to further clarify the concept of this invention, one exemplary embodiment of the invention will be specifically described referring to the accompanying drawings.

Figure 1:
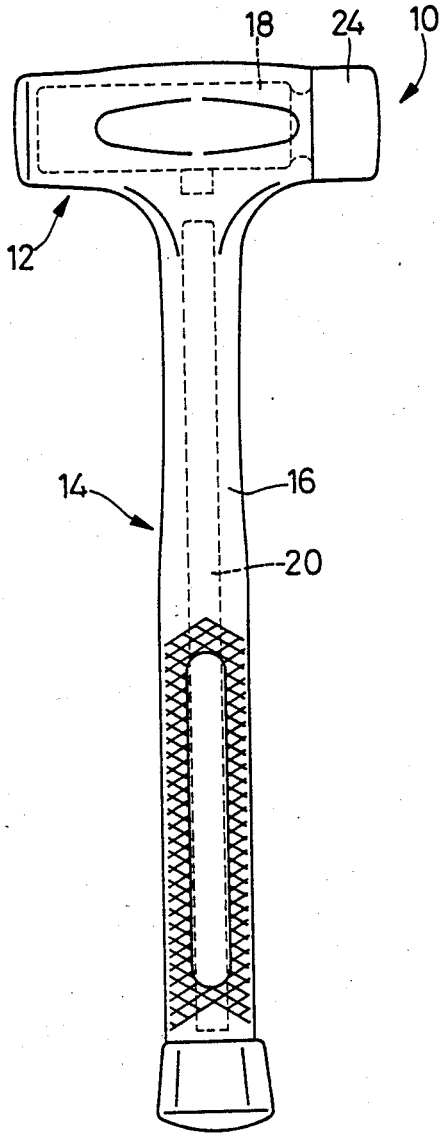
FIG. 1 is a side elevational view of an integrally molded hammer embodying the invention.
Figure 2:
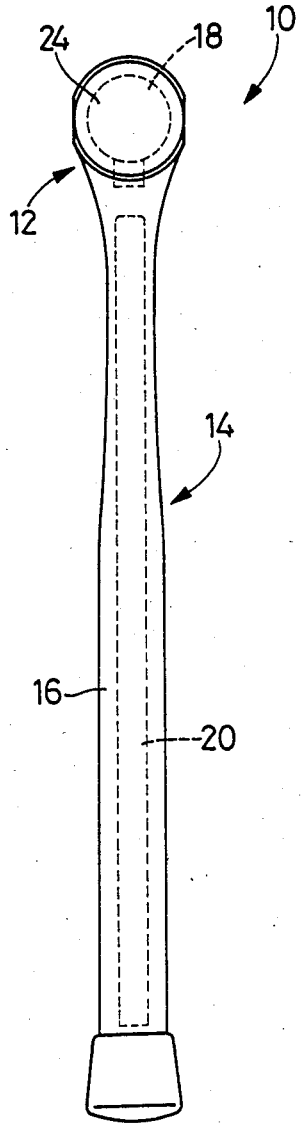
FIG. 2 is a front elevational view of the hammer of FIG. 1.

Referring first to side and front elevational views of FIGS. 1 and 2, respectively, there is shown a hammer 10 constructed in accordance with the present invention. The hammer 10 is a generally T-shaped shaped body comprising a head portion 12 and a handle portion 14 which are integrally molded of a polyurethane resin material 16 having Shore hardness 60 (Hs-D scale). In the head portion 12, a head core 18 made of carbon steel S55C for mechanical structure and having a round cross sectional shape is imbedded such that the head core 18 extends in the longitudinal direction of the head portion 12. A handle core 20 made of carbon steel S40C for mechanical structure with a round cross-sectional shape is imbedded in the handle portion 14 so as to extend in the longitudinal direction of the handle portion 14.

Figure 3:
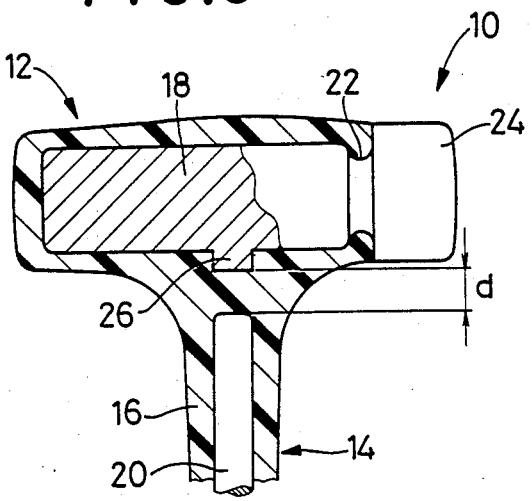
FIG. 3 is a fragmentary view in cross section of a head portion of the hammer of FIG. 1, and a part of a handle portion of the hammer.

As shown also in a fragmentary cross sectional view of FIG. 3, the head core 18 has at its one end a constricted or neck part 22 and an impact part 24 extending from the neck part 22. The impact part 24 is exposed at one end of the head portion 12, thereby providing one of two opposed impact surfaces (metallic and resin-covered peens) of a hammer 10. The neck part 22 defines a circumferential groove for accepting a portion of the polyurethane resin material 16, so as to hold or lock the head core 18 firmly in position. The other end of the head core 18 is covered with a layer of the polyurethane resin material 16 with a predetermined thickness to provide the other impact surface of the hammer 10.

The longitudinally central part of the head core 18 is formed with a projection 26 which extends a short distance radially outwardly toward the handle portion 14, so that the end surface of the projection 26 is spaced a predetermined distance "d" from the corresponding end of the handle core 20. This distance "d" is suitably selected within a range of 3–30 mm, and a space corresponding to the distance "d" between the head and handle cores 18, 20 is filled with a portion of a mass of the polyurethane resin material 16 which encases the head and handle cores 18, 20, except the impact part 24 that is exposed. Namely, the head and handle cores 18, 20 are separated from each other by a portion of the polyurethane resin mass 16 which connects the head and handle portions 12, 14. The handle core 20 is a cylindrical rod which is cut to a suitable length, and the end of the handle core 20 opposite to the projection 26 is given a round edge. It will be understood that the polyurethane resin mass 16 forms a unitary covering member of the hammer 10.

The hammer 10 can be manufactured readily and quickly by injecting or casting the polyurethane resin material 16 into a cavity of a mold, which has the same shape as the external shape of the hammer 10 and in which the head and handle cores 18, 20 are arranged so as to form a T-shape, with the predetermined distance "d" left therebetween.

In the hammer 10 constructed as stated above, wherein the head core 18 and the handle core 20 are separated from each other by the resin material 16, an impact recoil given to the head portion 12 when the hammer 10 is struck against an object is absorbed by the portion of the resin material 16 between the head and handle cores 18, 20, and the propagation of the impact recoil from the head portion 12 to the handle portion 14 is greatly reduced. This permits a remarkable reduction of a shock given to the worker's hand holding the handle portion 14. The thus constructed hammer 10 maintains high recoil-inhibiting capability for a comparatively longer period, unlike a conventional hammer containing recoil-inhibiting lead pellets which tend to gather into blocks during use, and consequently suffer a reduction in their recoil-inhibiting function.

Moreover, since the shock given to the handle portion 14 is mitigated by restraining the impact propagation between the head and handle portions 12, 14, a striking or impact force of the head portion 12 to be exerted to an object, and the resulting rebound of the hammer 10 will not be reduced. Therefore, the user can perform efficient hammering operations with easy backswing actions, and with greatly reduced hammering efforts.

In addition to having such prominent operating advantages, the hammer 10 in this embodiment requires a reduced number of manufacturing steps and a reduced material cost, leading to a considerable savings in overall cost of manufacture, as compared with the conventional shock-proof hammer filled with lead pellets. Described more specifically, the present hammer 10 having the above-indicated shock-absorbing capabilities, is produced by a simple molding process in which the head and handle cores 18, 20 are first disposed in the mold with the predetermined distance "d" kept therebetween, and the selected polyurethane resin material 16 is introduced into the mold so that the cores 18, 20 are encased in and connected by the cured mass of the resin material 16.

While the strength of the hammer 10 is more or less reduced at the connection between the separate head and handle cores 18, 20, the connection has a practically sufficient strength while keeping the intended shock-absorbing effect, because a hard polyurethane resin is employed as the resin material 16 for encasing and connecting the head core 18 and the handle core 20, and because the distance "d" is suitably determined to be within 3–30 mm. In this connection, it is noted that the rounded edge of the handle core 20 at its end on the side of the head core 18 contributes to the effective protection of the polyurethane resin material 16 against cracking due to stresses caused by striking the hammer 10. Further, the impact force and the rebound of the hammer 10 can be adjusted as needed by changing the spacing distance "d" and/or the kind of the resin material 16 which connects the cores 18, 20.

Figure 4:
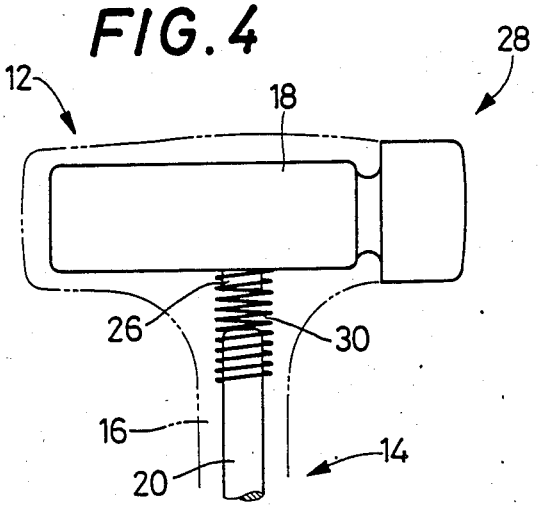
FIG. 4 is a fragmentary view illustrating another embodiment of the invention, showing a structure for connecting head and handle cores of the hammer.

Although the head core 18 and the handle core 20 are completely separated from each other in the present embodiment, it is possible to connect the projection 26 of the head core 18 to the handle core 20 by a resilient member in the form of a coil spring 30 as used in a hammer 28 shown in FIG. 4, so as to allow a relative displacement between the cores 18, 20. In this case, the connection is imbedded within the integral casing of the resin material 16. This arrangement eliminates a possibility that the head portion 12 may go off from the handle portion 14 in the event of a fracture of the resin material 16 at the connection between the cores 18, 20 due to impact stresses applied to the hammer 28. Thus, the hammer 28 provides improved operating safety.

Inventors conducted tests to evaluate driving forces and rebound distances of the hammers of the present embodiment, to more particularly clarify the advantages of the present invention.

Figure 5:
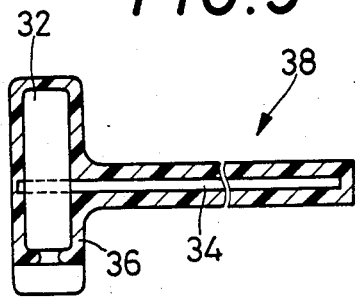
FIGS. 5 through 8 are views illustrating conventional hammers used in drive and rebound tests as comparative samples.
Figure 6:
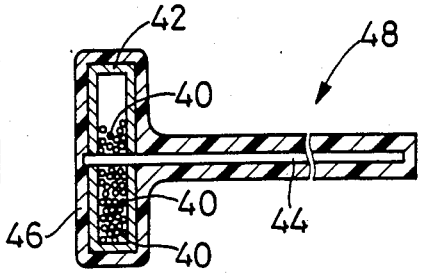
Figure 7:
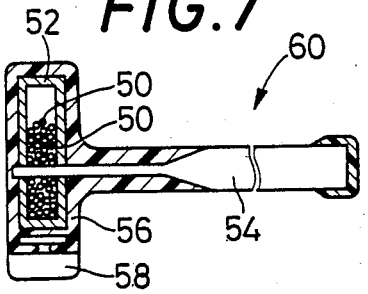
Figure 8:
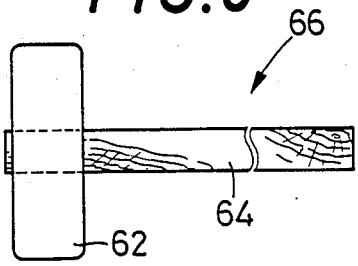

These tests were performed on eight kinds of hammers, that is, Samples A to D of the present invention and Comparative samples E to H as follows:

Sample A: hammer 10 whose distance "d" is 5 mm;
Sample B: hammer 10 whose distance "d" is 10 mm;
Sample C: hammer 10 whose distance "d" is 20 mm;
Sample D: hammer 10 whose distance "d" is 30 mm;
Comparative Sample E: Hammer 38 as shown in FIG. 5, wherein a head core 32 and a handle core 34 are connected to each other, and one end of the head core 32 is exposed out of a polyurethane resin encasement 36 to form one impact portion;
Comparative Sample F: hammer 48 as shown in FIG. 6, wherein a head core 42 filled with many lead pellets 40 and a handle core 44 are connected to each other, and the head core 42 is completely covered up with a polyurethane resin encasement 46;
Comparative Sample G: hammer 60 as shown in FIG. 7, wherein a head core 52 filled with many lead pellets 50 and polycarbonate resin handle portion 54 are connected to each other, the head core 52 being completely covered up with a polyurethane resin encasement 56, and having one metallic impact portion 58;
Comparative Sample H: hammer 66 as shown in FIG. 8, comprising a metallic head portion 62 and a wooden handle portion 64 which are connected to each other.

All of the above samples include head core 32, impact portion 58 and head portion 62, made of the same carbon steel S55C for mechanical structure as the head core 18 of the hammer 10 of the invention. The polyurethane resin encasements 36, 46 and 56 have the same hardness (Shore hardness, about 60, Hs-D scale) as the polyurethane resin material 16 of the hammer 10. The weight of the head portion of each hammer is as follows: Samples A–D; 490 g, Sample E; 490 g, Sample F; 287 g, Sample G: 336 g, Sample H; 454 g.

Figure 9:
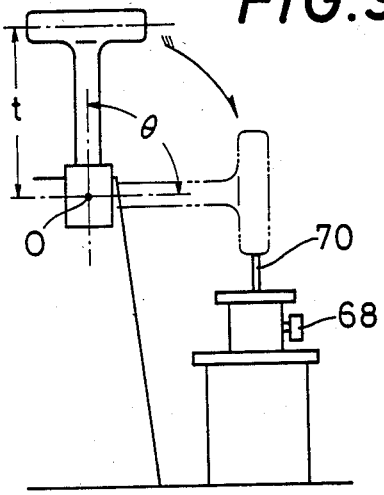
FIG. 9 is a schematic view of a device used for the drive test.

The drive test was performed as shown in FIG. 9. Each hammer was swung about point O by gravity in the direction of the arrow, from its upright starting position at which the head portion takes a horizontal posture. A pin 70 was tightened on a support 69 with a cap screw 68 to 50 Kg/cm, so that the head portion strikes the pin 70. The striking or driving force was determined by measuring a distance over which the pin 70 was driven. Striking operations were performed 10 times for each hammer with the metallic or polyurethane resin impact portion. A distance "t" from point O to the center of the head portion was 24 cm, and a swing angle "$\theta$" of the hammer was 90°.

Figure 10:
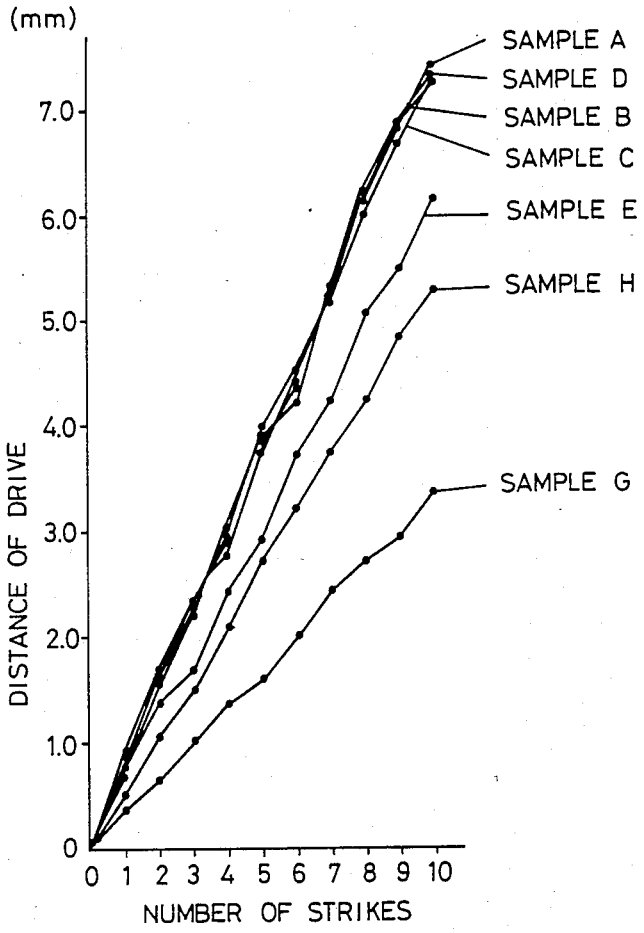
FIGS. 10 and 11 are line graphs showing a distance of drive of an object in relation to number of strikes of the hammer in the drive test, FIG. 10 relating to the results on the metallic impact portion of the hammer, and FIG. 11 on the impact portion made of a polyurethane resin material.
Figure 11:
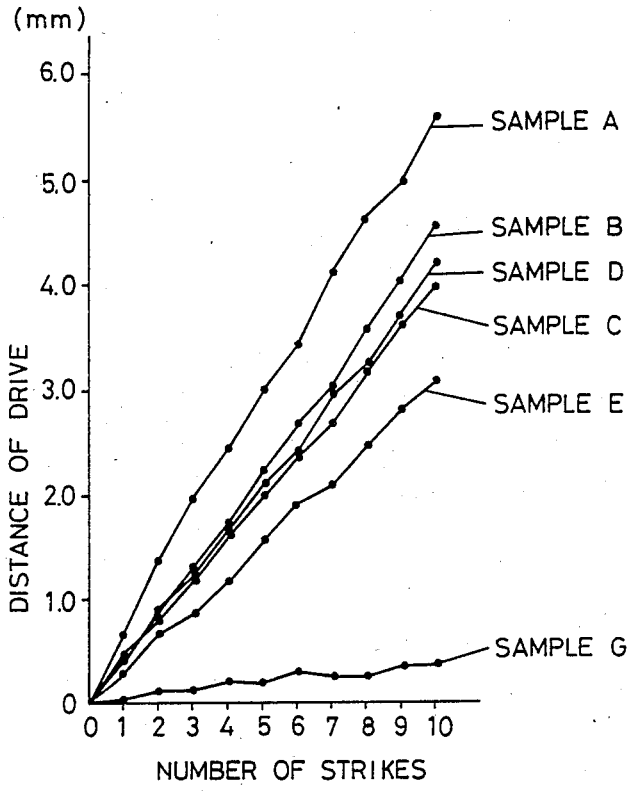

FIGS. 10 and 11 are line graphs showing the results obtained in the drive test. The graphs in FIG. 10 indicate the results of the hammers with the metallic impact portion, and the graphs in FIG. 11 indicate the results of the hammers with the polyurethane resin impact portion. More specifically, these graphs show an accumulative distance of drive (mm) of the pin 70 with each strike, a total of ten strikes by each hammer.

As clearly shown in FIGS. 10 and 11, the hammers (Samples A–D) of the present invention, with either the metallic or the polyurethane resin impact portion, demonstrated remarkably improved striking forces over not only the hammers filled with lead pellets (Sample G) but also the hammers wherein the head and handle portions are connected (Sample E) and the hammers with the metallic head portion (Sample H). The above results of the hammers 10 of the invention are due to the fact that the striking or driving force was promoted by resiliency of a portion of the polyurethane resin material 16 which elastically connects the head core 18 and the handle core 20. It was also found that the impact portion made of polyurethane resin material had a smaller striking force than that made of metal. Elastic deformation of the polyurethane resin material abutting the impact pin 70 results in the impact portion absorbing a part of an impact force that drives the pin 70.

Figure 12:
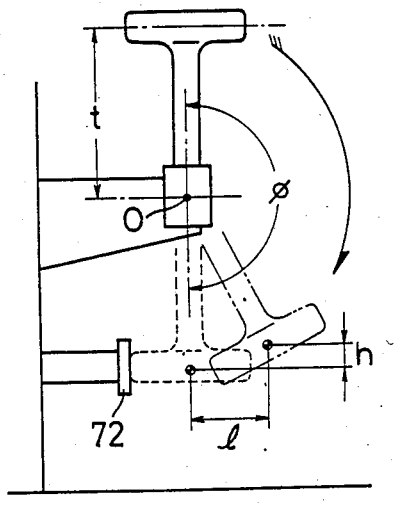
FIG. 12 is a schematic view which illustrates a device used for the rebound test.
Figure 13:
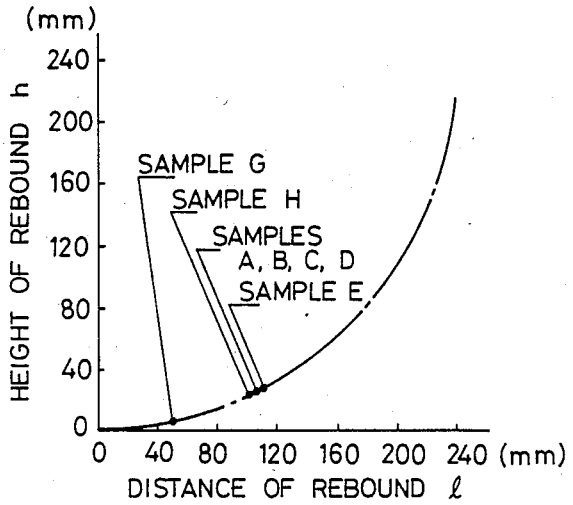
FIGS. 13 through 16 are graphical representations of the results of the rebound test, FIGS. 13 and 14 relating to the results obtained where the hammers were swung 90 degrees, FIGS. 15 and 16 relating to the results where the hammers were swung 180 degrees, FIGS. 13 and 15 illustrating the results on the metallic impact peen, and FIGS. 14 and 16 illustrating the results on the polyurethane resin-covered impact peen.
Figure 14:
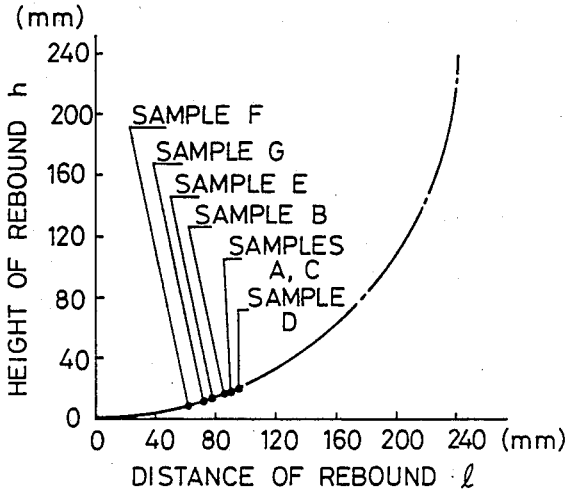
Figure 15:
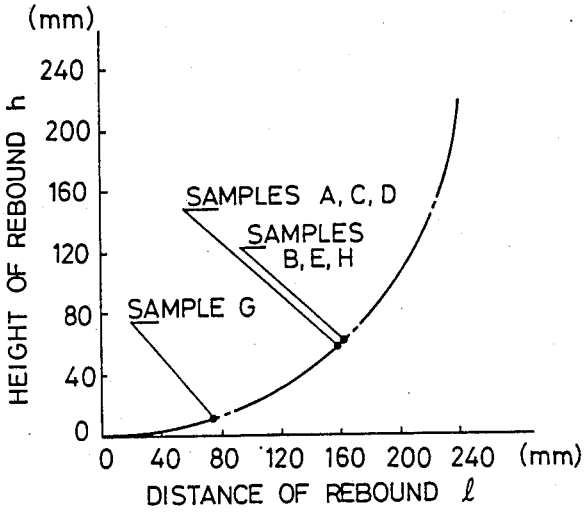
Figure 16:
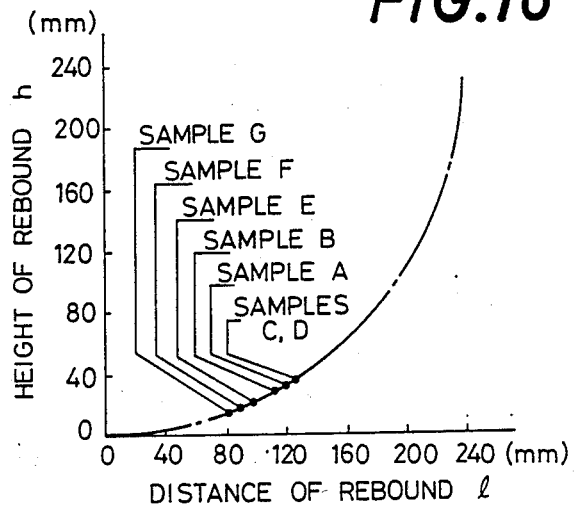

In addition, the rebound test was carried out on a device shown in FIG. 12, in the following manner: rebound distance "l" and rebound height "h" were determined by the position to which the head portion of each hammer rebounded when the hammer was swung by gravity about point O, and the head portion was struck against a fixed iron plate 72 at the lowermost point on the swing path. The tests were performed on the hammers with the metallic or polyurethane resin impact portion with swing angles "$\phi$" of 90° and 180°. A distance "t" from point O to the center of the head portion was 24 cm. FIGS. 13 to 16 show the results of the rebound test, where a circular arc represented in broken line shows a moving locus (swing path) of the head portion, and the origin shows the point of impact where the head portion was struck against the plate 72. In FIGS. 13 and 14, the swing angle "$\phi$" was 90°, while in FIGS. 15 and 16 the swing angle "$\phi$" was 180°. FIGS. 13 and 15 show the results on the hammers with the metallic impact portion and FIGS. 14 and 16 show those with the polyurethane resin impact portion. As clearly shown in FIGS. 13 through 16 the hammers (Samples A–D) of the present invention showed a larger rebound than the hammers (Samples F, G) filled with lead pellets. The hammers of the present invention with the metallic impact portion (FIGS. 13 and 15) had almost the same rebound as the hammer (Sample E) with the connected core members and the hammer (Sample H) with the metallic head portion. In other words, the hammers of the invention do not have an excessive amount of rebound when they are struck at the metallic impact portion. The hammers of the invention with the polyurethane resin impact portion (FIGS. 14 and 16 had an increased rebound, as compared with the comparative Samples E, F and G. Therefore, the hammers of the present invention can easily make repeated striking actions, when they are struck at the elastic impact portion.

While the hammers 10 and 28, have one end of the head core 18 exposed out of the polyurethane resin covering member 16 to form the metallic impact portion, the head core 18 may be completely encased within the polyurethane resin covering member 16.

Though not shown in the illustrated embodiment, carbon steel for mechanical structure or different resin materials can be used. Further, the handle core 20 may be formed of a polycarbonate resin in an "H" cross sectional shape.

Figure 17:
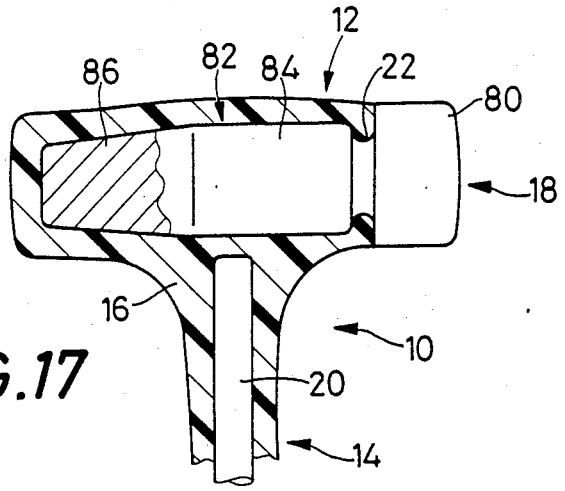
FIGS. 17 and 18 are cross-sectional views illustrating modified embodiments of this invention, which correspond to FIG. 3.

In FIG. 17 there is shown a usefully modified embodiment of the present invention, wherein a head portion 12 and a handle portion 14 are made of a suitable resin material and cooperate to form a generally T-shaped integral body, as in the preceding embodiments of FIGS. 1 and 4, comprising a longitudinal head core 18 which is imbedded in the resin mass 16, except one of its opposite ends so as to provide an impact surface, and a handle core 20 which is imbedded in the handle portion 14 such that the handle core 20 is separated from the head core 18 by the resin material 16. In this embodiment, an end portion of the head core 18 remote from the impact surface has a transverse dimension which decreases in a longitudinal direction over a predetermined length toward the impact surface.

As shown in FIG. 17, the head core 18 has at one end a large-diameter part 80 with generally the same diameter as the outside diameter of the head portion 12, and at the other end a small-diameter part 82 with a diameter smaller than that of the large-diameter part 80. The head core 18 is imbedded in the covering member 16 such that the large-diameter part 80 is exposed at one of its opposite ends of the head portion 12. Thus, the large-diameter part 80 of the head core 18 provides one impact surface (metallic peen) of the hammer 10. The end face of the head core 18 on the side of the small-diameter part 82 of the head core 18 is covered with a layer of the covering member 16, which provides the other impact surface of the hammer 10. The connecting part between the large- and small-diameter parts 80, 82 is formed with a circumferential groove or neck part 22 for accepting a portion of the resin mass (covering member) 16 so as to hold the head core 18 firmly in position.

The end of the handle core 20 is separated from the circumferential surface of the small-diameter part 82 of the head core 18, by a 5 mm distance, and the spacing is filled with a portion of the resin mass 16. In addition, the end of the handle core 20 opposite to the head core 18 is rounded, which preferably distributes impact stresses given to the end portion of the handle core 20 when the hammer is struck against an object.

The small-diameter part 82 of the head core 18 comprises two sections. Namely, approximately half of the small-diameter part 82 on the side of the large-diameter part 80 is formed as a cylindrical section 84 having a uniform diameter over its length, and the other section of the small-diameter part 82 is formed as a tapered section 86 in the shape of a truncated cone. The diameter of the tapered section 86 gradually decreases from the end adjacent to the cylindrical section 84 toward the other end opposite to the large-diameter part 80. In the present embodiment, the taper angle of the tapered section 86 is selected to be about 6 degrees, and the length of the tapered section 86 is selected to be about 28 mm.

In the hammer 10 of this embodiment, the space corresponding to the 5 mm distance between the head and handle cores 18, 20 is filled with a portion of the polyurethane resin mass 16. This arrangement remarkably mitigates the propagation of the shock from the head portion 12 to the handle portion 14 when the hammer is struck, and thus reduces the shock given to the user's hand through the handle portion 14. Unlike the conventional hammer in which shock-absorbing lead pellets are apt to lose their recoil-inhibiting function due to friction heat during use, the hammer of the present invention maintains a preferable shock-absorbing effect for a long period. In the present hammer, the striking or driving force will not be absorbed by the friction of lead pellets, and the working efficiency will not be reduced, either.

Moreover, when the resin-covered peen, i.e., the impact surface covered with the polyurethane resin layer 16 is used for striking, the hammer 10 preferably protects the resin layer 16 against cracking around the end portion of the head core 18 neighboring the impact surface. Described more specifically, durability of the small-diameter part 82 in the head core 18 is remarkably and advantageously improved, as compared with the hammer including a cylindrical head portion having the same outside diameter over its entire length as indicated in FIG. 3. This is because of the tapered section 86, wherein the outside diameter is tapered. Compared with the stresses which would be exerted on the resin mass 16 if the small-diameter part 82 consists solely of the cylindrical section 84, the stresses to be exerted upon the part of the resin mass 16 are reduced, by means of uniform distribution of the impact load at the striking moment.

In this connection, the experiments using the resin-covered impact surface under the same conditions proved that about 8,000–9,000 strikes of the hammer of FIG. 3 were necessary to cause cracking on the polyurethane resin material 16, while about 20,000–22,000 strikes of the hammer of this embodiment brought about no cracking of the polyurethane resin material 16.

In the present example of FIG. 17, the head core 18 is made of carbon steel S55C for mechanical structure and the handle core 20 is made of carbon steel S40C for mechanical structure respectively, and the cores 18, 20 are covered with and connected by the hard polyurethane resin material 16 to construct the hammer 10. Other suitable metallic and resin materials, however, can be employed for the cores 18, 20 and the covering member 16.

Although, in this example the tapered section 86 of the small-diameter part 82 of the head core 18 is determined to be approximately 28 mm in length and approximately 6 degrees in taper angle, those dimensions can be changed according to the kind of the resin material and/or the size of the hammer. The length of the tapered section 86 is usually determined to be within a range of 25–30 mm.

The spacing distance between the head and handle cores 18, 20 is not limited to 5 mm, but can be changed according to the kind of the resin material and/or the size of the hammer, as well as the size of the tapered section 86.

Figure 18:
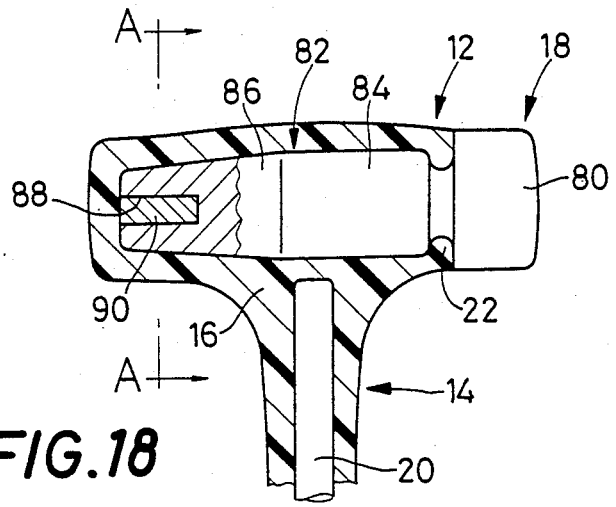
Figure 19:
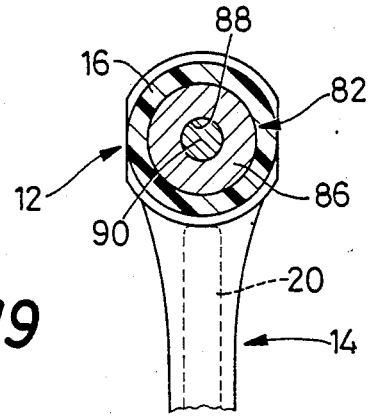
FIG. 19 is a cross-sectional view taken along line A—A of FIG. 18.

Furthermore, another preferred modified embodiment of the present invention is shown in FIGS. 18, 19. Described more specifically, there is shown a hammer including head and handle portions 12, 14 made of a suitable resin material 16 and cooperating to form a generally T-shaped integral body, comprising a longitudinal head core 18 which is imbedded in a longitudinal direction of the head portion 12 except one end of the head core 18 that is exposed so as to provide a metallic impact peen, the head core 18 being separated from a handle core 20 by the resin material 16 and imbedded in the handle portion 14. The thus integrally molded hammer is constructed such that the head core 18 has a balance weight 90 at the end portion opposite to the metallic impact peen. The balance weight 90 is made of a material having a larger specific gravity than that of the material of the head core 18.

As shown in the figures, the head core 18 comprises a large-diameter part 80 at one end, having almost the same outside diameter as that of the head portion 12, and a small-diameter part 82 at the other end, having a diameter smaller than that of the large-diameter part 80.

The small-diameter part 82 is imbedded in the head portion 12 while the large-diameter part 80 is exposed at one end of the head portion 12. Specifically the large-diameter part 80 of the head core 18 provides a metallic impact surface of the hammer, and the end portion on the side of the small-diameter part 82 of the head core 18 is covered with a layer of the resin material 16 having a predetermined thickness, to provide a resin-covered impact peen.

Approximately half of the small-diameter part 82 of the head core 18 is formed as a cylindrical section 84 having a uniform outside diameter, and the rest of the small diameter part 82 is formed as a tapered section 86 in the form of a truncated cone whose transverse dimension gradually decreases from the end adjacent to the cylindrical section 84 toward the other end. This construction effectively protects the resin material 16 from cracking when the impact part covered with the resin material 16 is struck. The neck part connecting the small-diameter part 82 and the large-diameter part 80, as previously mentioned in the preceding embodiments, defines a circumferential groove 22 wherein the resin material 16 is introduced so as to lock the head core 18 firmly in position.

The handle core 20 is spaced at its one end by a predetermined distance from the circumferential surface of the small-diameter part 82 of the head core 18. Namely, the handle core 20 is separated from the head core 18 by a portion of a mass of the resin mass 16 therebetween. The end portion of this handle core 20 opposite to the head core 18 is rounded to form a round edge, and thus the impact load given to the end portion of the handle core 20 is preferably distributed when the hammer is struck against an object.

In addition, the tapered section 86 has a round hole 88 which is open at the end face of the small-diameter part 82. A cylindrical balance weight 90 made of lead is received in the hole 88 so that the head portion 12 may be substantially balanced in its longitudinal direction.

Since the balance weight 90 is built in the end portion of the tapered section 86 on the side of the small-diameter part 82 of the head core 18, the weights of the two parts of the head portion 12 on both sides of the handle portion 14 are approximately the same. As a result, regardless of whether the metallic peen of the large-diameter part 80 or the resin-covered peen is used, the user of the hammer will have almost the same operational feel as expected from experience with the conventional hammer.

In the above-mentioned embodiment, the head core 18 is made of carbon steel S55C for mechanical structure while the balance weight 90 is made of lead. But the materials for the head core and the balance weight are not limited to those exemplified above. The material for the balance weight, as a matter of course, should have a specific gravity larger than that of a material of the head core.

While the present invention has been described in its preferred embodiments with a certain degree of particularity, it is to be understood that the invention is by no means confined to the precise disclosure contained herein, but may be embodied with changes, modifications and improvements which may occur to those skilled in the art, without departing from the spirit and scope of the invention defined in the appended claims.

What is claimed is:

1. A hammer, comprising:

a head portion made of a resin material;

a handle portion made of a resin material cooperating to form a generally T-shaped integral body with said head portion;

a head core imbedded in said head portion in a longitudinal direction of said head portion, at least one end of said head core being exposed, so as to provide an impact surface at said at least one exposed end;

a handle core imbedded in said handle portion in a longitudinal direction of said handle portion, said head core and said handle core being separated from each other in said longitudinal direction of said handle portion by a predetermined distance by a portion of said resin material by which said head and handle portions are connected.

2. A hammer as set forth in claim 1, wherein said predetermined distance is within a range of 3–30 mm as measured between said head core and one of opposite ends of said handle core on a side of said head core.

3. A hammer as set forth in claim 1, wherein said resin material is polyurethane resin.

4. A hammer as set forth in claim 1, wherein said head core and said handle core are connected to each other by a resilient member.

5. A hammer as set forth in claim 4, wherein said resilient member comprises a coil spring.

6. A hammer as set forth in claim 1, wherein an opposite end portion of said head core on an end opposite said at least one exposed end has a transverse dimension which decreases toward said opposite end, over a predetermined length in the longitudinal direction of said head portion.

7. A hammer as set forth in claim 6, wherein said head core comprises a large-diameter part including said impact surface, a small-diameter part having said opposite end portion and imbedded in the resin material of said head portion, and a neck part connecting said large-diameter part and said small-diameter part, said neck part defining a circumferential groove.

8. A hammer as set forth in claim 1, wherein said head core comprises a large-diameter part including said impact surface, a small-diameter part imbedded in the resin material of said head portion, said small-diameter part incorporating a balance weight in an end portion opposite said at least one exposed end, said balance weight being made of a material having a specific gravity larger than that of a material of said head core, and a neck part connecting said large-diameter part and said small-diameter part, said neck part defining a circumferential groove.

9. A hammer as set forth in claim 8, wherein said head core is made of a ferrous material, and said balance weight is made of lead or a lead alloy, said balance weight extending from an end face opposite said at least one exposed end toward said at least one exposed end.

* * * * *